US008141877B2

(12) United States Patent
Santiago

(10) Patent No.: US 8,141,877 B2
(45) Date of Patent: Mar. 27, 2012

(54) METHOD OF PLAYING A MODIFIED POKER BASED WAGERING GAME WITH SIDE WAGER

(76) Inventor: William Santiago, Las Vegas, NV (US)

( * ) Notice: Subject to any disclaimer, the term of this patent is extended or adjusted under 35 U.S.C. 154(b) by 35 days.

(21) Appl. No.: 12/560,152

(22) Filed: Sep. 15, 2009

(65) Prior Publication Data

US 2010/0072704 A1 Mar. 25, 2010

Related U.S. Application Data

(60) Provisional application No. 61/097,196, filed on Sep. 15, 2008.

(51) Int. Cl.
*A63F 1/00* (2006.01)

(52) U.S. Cl. ..... 273/292; 273/274; 463/13

(58) Field of Classification Search ..... 273/292, 273/274, 309; 463/12, 13
See application file for complete search history.

(56) References Cited

U.S. PATENT DOCUMENTS 5,382,025 A 1/1995 Sklansky et al. ..... 273/292
2005/0107148 A1 * 5/2005 Webb ..... 463/13

OTHER PUBLICATIONS

How to Play Casino Poker—Texas Hold-em, Victor H. Royer, http://www.vegas.com/vegascom/betbasholdem. Received in the PTO on Jul. 11, 1996.

"World Series of Poker, Texas Hold'em Bonus", Progressive Gaming International Corporation. Received in the PTO on Nov. 14, 2006 at the Global Gaming Expo (G2E).

* cited by examiner

*Primary Examiner* — Benjamin Layno
(74) *Attorney, Agent, or Firm* — Howard & Howard Attorneys PLLC

(57) ABSTRACT

Some embodiments are directed to a method of playing a wagering game which comprises the steps of: receiving an ante wager from a participating player; delivering a partial hand of playing cards to the participating player; providing a community group of playing cards of unknown value; conducting one or more game events so long as there is at least one playing card of unknown value remaining among the community group of playing cards, wherein each game event comprises revealing the value of at least one playing card in the community group to the participating player and receiving a game event wager from the participating player thereafter; revealing the value of the at least one remaining unknown playing card among the community group; determining a final hand rank for the participating player, wherein the final hand rank is based on the cards in the participating player's partial hand and the community group of playing cards; comparing the final hand rank with a preset criteria, wherein the preset criteria sets forth guidelines for award payouts based on final hand ranks; and paying a game award payout to the player if one of the preset criteria are satisfied, wherein the game award payout is at least partially based on the total amount wagered, and wherein the total amount wagered is the ante wager plus the sum of all the game event wagers received during the one or more game events.

6 Claims, 1 Drawing Sheet

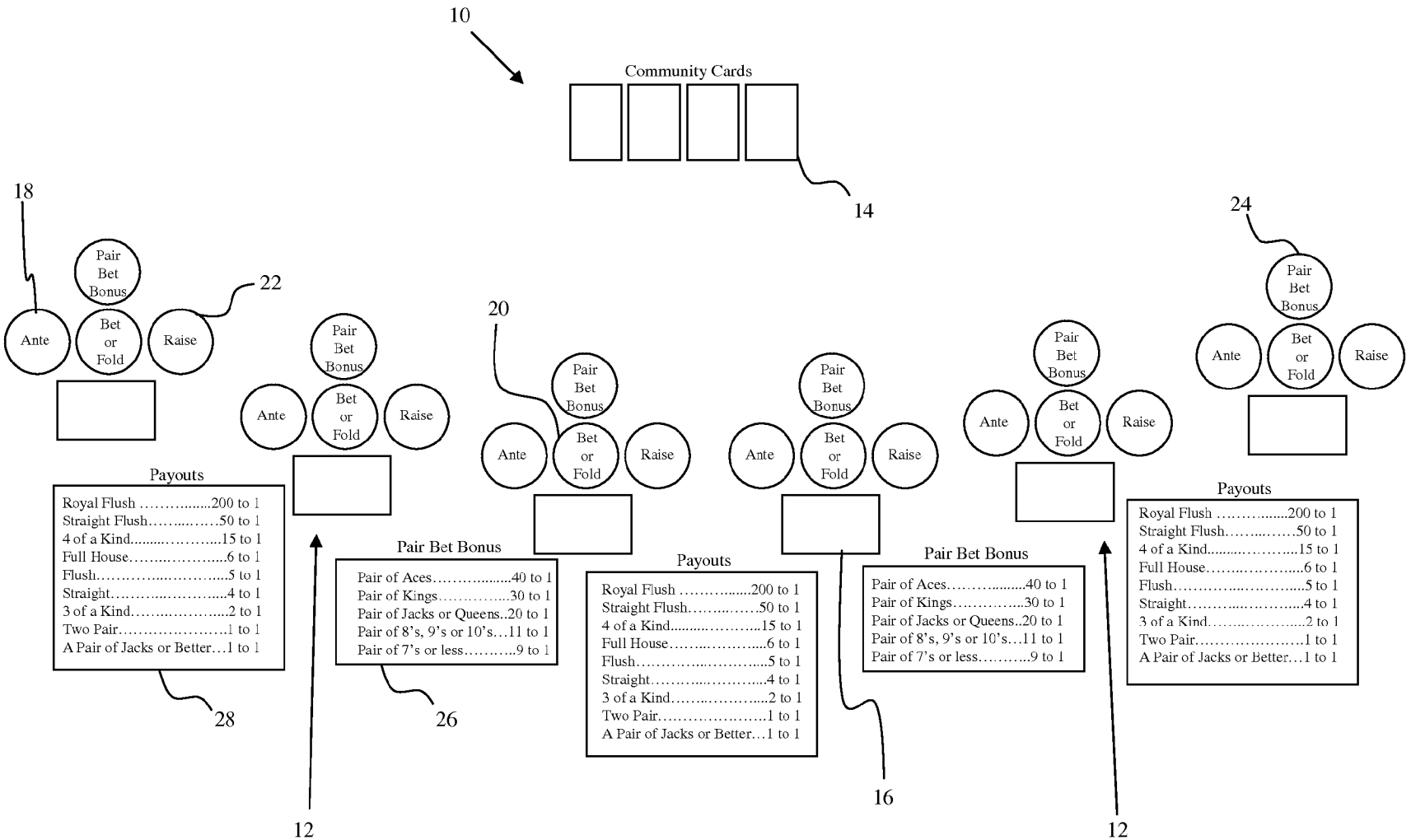
10
Community Cards
14
Ante
Bet or Fold
Raise
Pair Bet Bonus
18
20
22
24
12
16
26
28
Payouts
Royal Flush.....200 to 1
Straight Flush.....50 to 1
4 of a Kind.....15 to 1
Full House.....6 to 1
Flush.....5 to 1
Straight.....4 to 1
3 of a Kind.....2 to 1
Two Pair.....1 to 1
A Pair of Jacks or Better...1 to 1
Pair Bet Bonus
Pair of Aces.....40 to 1
Pair of Kings.....30 to 1
Pair of Jacks or Queens..20 to 1
Pair of 8's, 9's or 10's...11 to 1
Pair of 7's or less.....9 to 1

METHOD OF PLAYING A MODIFIED POKER BASED WAGERING GAME WITH SIDE WAGER

CROSS REFERENCE TO RELATED APPLICATIONS FROM WHICH PRIORITY IS CLAIMED

This application claims priority to U.S. Provisional Application Ser. No. 61/097,196, filed Sep. 15, 2008, the disclosure of which is hereby incorporated by reference in its entirety.

FIELD OF THE INVENTION

The invention is directed to wagering games, and more particularly, table games typically found in gaming establishments, such as those involving a playing surface, playing positions for multiple players, playing cards, and a dealer, or virtual representations thereof.

BACKGROUND OF THE RELATED ART

Gaming establishments or casinos continually require new games to offer their players. Casino games are generally configured to enable each player to play against a dealer provided by the casino or banker, rather than against other players.

Players are typically attracted to games that provide relatively decent odds of winning, as compared with other casino games, and can be played rapidly. However, many such games never become popular. It has been found that the games which have been successful also offer game play features that further serve to heighten player interest in such games. Naturally, casino operators seek to provide the most popular games for their gaming patrons.

SUMMARY OF THE INVENTION

In some embodiments, the invention is directed to a game that includes a plurality of wagering options and provide player with partial hand information upon which players may make further game play decisions.

In particular, some embodiments are directed to a method of playing a wagering game comprising the steps of: receiving an ante wager from a participating player; delivering a partial hand of playing cards to the participating player; providing a community group of playing cards of unknown value; conducting one or more game events so long as there is at least one playing card of unknown value remaining among the community group of playing cards, wherein each game event comprises revealing the value of at least one playing card in the community group to the participating player and receiving a game event wager from the participating player thereafter; revealing the value of the at least one remaining unknown playing card among the community group; determining a final hand rank for the participating player, wherein the final hand rank is based on the cards in the participating player's partial hand and the community group of playing cards; comparing the final hand rank with a preset criteria, wherein the preset criteria sets forth guidelines for award payouts based on final hand ranks; and paying a game award payout to the player if one of the preset criteria are satisfied, wherein the game award payout is at least partially based on the total amount wagered, and wherein the total amount wagered is the ante wager plus the sum of all the game event wagers received during the one or more game events.

In some embodiments, a preset amount of game events are conducted. In other embodiments, each game event comprises revealing the value of a random amount of playing cards in the community group to the participating player and receiving a wager from the participating player thereafter.

In some embodiments, the combined amount of cards revealed during the game events, cards in the partial hand and cards remaining unknown, is at least one card greater than necessary to determine the rank of the final hand. In other embodiments, the amount of cards revealed during the game events and the amount of cards in the partial hand are at least one card less than necessary to determine the rank of the final hand.

In some embodiments, the ante wager and at least one game event wager are mandatory wagers.

In some embodiments, the preset criteria and corresponding game awards comprise a paytable listing achievable hand ranks and corresponding numerical multiplier of the total amount wagered. In some embodiments, the ranking is based on five card poker ranks.

In some embodiments, the aforementioned method further comprises a secondary game including the steps of: receiving a secondary game wager prior to delivering the partial game hand to the participating player; determining a partial hand rank for the participating player, wherein the partial hand rank is based on the cards in the participating player's partial hand; comparing the partial hand rank with a secondary game preset criteria, wherein the secondary game preset criteria sets forth guidelines for award payouts based on partial hand ranks; and paying a secondary game award payout to the participating player if one of the secondary game preset criteria are satisfied, wherein the secondary game award payout is at least partially based on the secondary game wager amount.

The invention is also directed to a system for providing a wagering game as described herein. In some embodiments, the system includes an input device configured for receiving an ante wager from a participating player; a processor configured for providing the participating player with a partial hand of playing cards, providing a community group of playing cards of unknown value, conducting one or more game events so long as there is at least one playing card of unknown value remaining in the community group of playing cards, wherein each game event comprises revealing the value of at least one playing card in the community group to the participating player and receiving a game event wager from the participating player thereafter, revealing the at least one remaining playing card of unknown value among the community group of playing cards, determining a final hand rank for the participating player, wherein the final hand rank is based on the cards in the participating player's partial hand and the community group of playing cards, and comparing the final hand rank with a preset criteria, wherein the preset criteria sets forth guidelines for award payouts based on final hand ranks. The system may further include a display device configured for displaying the partial hand of playing cards to the participating player and revealing the value of the community group of cards during the game, and an output device for paying a game award payout to the player if one of the preset criteria are satisfied, wherein the game award payout is at least partially based on the total amount wagered, and wherein the total amount wagered is the ante wager plus the sum of all the game event wagers received during the one or more game events.

In some embodiments of the aforementioned system, a preset amount of game events are conducted by the processor. In some embodiments, there is a first display device for displaying the player's partial hands and a second display device for revealing the community cards.

In some embodiments, the combined amount of cards revealed during the game events via the display device, cards in the partial hand and cards remaining unknown is at least one card greater than necessary to determine the rank of the final hand. In some embodiments, the amount of cards revealed during the game events on the display device and the amount of cards in the partial hand are at least one card less than necessary to determine the rank of the final hand.

In some embodiments, the ante wager and at least one game event wager are mandatory wagers.

In an alternative embodiment, the input device is further configured for receiving a secondary game wager prior to delivering the partial game hand to the participating player, and the processor is further configured for determining a partial hand rank for the participating player, wherein the partial hand rank is based on the cards in the participating player's partial hand, comparing the partial hand rank with a secondary game preset criteria, wherein the secondary game preset criteria sets forth guidelines for award payouts based on partial hand ranks, and paying a secondary game award payout to the participating player if one of the secondary game preset criteria are satisfied, wherein the secondary game award payout is at least partially based on the secondary game wager amount.

The invention is further directed to a method of playing a wagering game comprising the steps of: receiving an ante wager from a participating player; dealing a partial hand of playing cards to the participating player; providing a community group of playing cards of unknown value; conducting one or more game events until there are at least four cards of known value to the participating player including the player's partial hand, wherein each game event comprises revealing the value of at least one playing card in the community group to the participating player and receiving a game event wager from the participating player thereafter; revealing the value of the remaining unknown playing cards among the community group; determining a final hand rank for the participating player, wherein the final hand rank is based on the cards in the participating player's partial hand and the community group of playing cards; comparing the final hand rank with a preset criteria, wherein the preset criteria sets forth guidelines for award payouts based on final hand ranks; and paying a game award payout to the player if one of the preset criteria are satisfied, wherein the game award payout is at least partially based on the total amount wagered, and wherein the total amount wagered is the ante wager plus the sum of all the game event wagers received during the one or more game events.

In some embodiments of the aforementioned method, the partial hand comprises two cards. In some embodiments, the community group of cards comprises four cards.

In some embodiments, the aforementioned method further comprises the steps of: receiving a secondary game wager prior to delivering the partial game hand to the participating player; determining a partial hand rank for the participating player, wherein the partial hand rank is based on the cards in the participating player's partial hand; comparing the partial hand rank with a secondary game preset criteria, wherein the secondary game preset criteria sets forth guidelines for award payouts based on partial hand ranks; and paying a secondary game award payout to the participating player if one of the secondary game preset criteria are satisfied, wherein the secondary game award payout is at least partially based on the secondary game wager amount.

In some embodiments of the aforementioned method, the ante wager and at least one game event wager are mandatory wagers.

BRIEF DESCRIPTION OF DRAWINGS

FIG. 1 illustrates an exemplary game layout for use in conjunction with some embodiments of the invention.

DETAILED DESCRIPTION OF THE INVENTION

In some embodiments, the invention is directed to a system and method of playing a modified poker based wagering game which offers players multiple wagering options and staggered partial hand information upon which to make further game decisions.

In some embodiments, the game begins by receiving an ante wager from each participating player. Each participating player is then dealt a partial hand, wherein the partial hand includes only a portion of the cards necessary to form a final hand upon which a final outcome in the game will be determined. Once all participating players receive their respective partial hands, a group of community cards are dealt. The community cards will ultimately be used by each participating player, in combination with their respective partial hand, to form a final hand upon which the final game outcome will be based.

In some embodiments, at least one of the community cards is revealed to all the players at a first game event, and players may place a second wager in addition to their ante bet. Players are therefore provided with additional partial hand information upon which to make a game decision at this game event, wherein the cumulative partial hand information now consists of each player's respective partial hand and at least one of the community cards. In some embodiments, players must place this second wager or fold (i.e., forfeit the game and ante wager) during this game event.

After players either place an additional wager or fold, assuming there are participating players remaining in the game, at least one other of the community cards will be revealed and players may place a third wager in addition to the ante and second wagers. Thus, players are provided with further hand information upon which to make another game decision at another game event, wherein the cumulative partial hand information now consists of each player's respective partial hand and at least two of the community cards. In some embodiments, players may place the third wager or check, that is, players may choose not to place a wager yet remain in the game as participating players without folding.

In some embodiments, the above steps continue until there is only one remaining community card in the group which is unknown, thus sequentially presenting each remaining player with additional game events based on ever-increasing partial hand information until the final card is revealed and the complete hand is made known. In some embodiments, game events occur in random amounts that may be preset prior to each game. In other embodiments, the number of game events is preset and remains constant. In yet other embodiments, the number of game events is selected to maintain a set ratio of community cards revealed to community cards remaining unknown, such as equal amounts revealed to unknown.

In some embodiments, each particular community card revealed from the group of community cards is randomly selected. In some embodiments, the amount of community cards selected to be revealed at each game event is randomly selected, preset or remains the same at each event.

Once all players have reached the final game event and made a final game decision accordingly, the remaining community card(s) are revealed and each player will use their respective partial hands and the community card(s) to form a respective final hand. The value of the final hand is the highest ranking poker hand which is possible from the population of cards in the player's partial hand and available community cards. In some embodiments, each remaining player is paid an award based on the amount wagered and rank of their final hand.

In some embodiments, each player is dealt two cards to form a partial hand and four community cards are dealt. In this embodiment, a ratio of two revealed cards to two unknown community cards is preset. Thus, a first game event consists of revealing a community card upon which players must make a first game decision as described above, that is, place a wager or fold. A second community card is revealed at a second game event and players must again make a game decision. In this embodiment, players may optionally place a wager at the second game event. Thus, in this embodiment, a total of three wagers may be placed by players remaining in the game, that is, an ante, a first wager upon revealing the first community card, and a second wager upon revealing the second community card. Upon either placing the third wager or checking, the remaining two community cards are revealed and players form a final hand based on the highest ranking five card poker hand achievable from the six cards consisting of each of their respective two card hands along with the four community cards.

In this embodiment, each player's final hand is compared to a paytable wherein the payout amounts are expressed as an odds payout or as a multiple of the total amount wagered. In some embodiments, the total amount wagered consists of the sum of the ante bet, second wager and third wager, if any. Players may only be allowed to place second and third wagers which are equal to the original ante wager.

Some embodiments of the game may further include side wagers to participate in a secondary game in which an award is paid only if one or more secondary game preset criteria are satisfied. For example, players may place a side wager which is paid based on the value of cards in the player's partial hand achieving a preset rank.

FIG. 1 illustrates an exemplary embodiment of a game layout which may be used to facilitate participation in some embodiments of the game described herein, generally designated by the reference numeral 10. Layout 10 may be constructed of any suitable materials or presented electronically on a display device. In this embodiment, layout 10 includes a plurality of player positions 12 disposed in a generally semicircular relationship about a community card area 14. Each player position 12 includes an area for partial hand information 16, an area for placing the ante bet 18 (represented by a circle with "ante" indicia therein), an area for placing the second wager 20 (represented by a circle with "bet or fold" indicia therein), an area for placing the third wager 22 (represented by a circle with "raise" indicia therein) and an area for placing a side wager 24 (represented by a circle with "pair bet bonus" indicia therein) to play a secondary game.

In this embodiment, players place an ante wager in ante area 18 to participate in the game. The secondary game may be played when the player places a wager in the side wager area 24 along with the ante wager and prior to the dealing of the partial hand.

Cards are delivered or dealt to partial hand area 16 associated with the player position 12 for each participating player to form the player's partial hand. Community cards are delivered or dealt to community card area 14. The player's partial hand may then be compared with the preset criteria to determine if an award has been achieved. An exemplary paytable for the side wager is shown below in Table 1 and illustrated in layout 10 by the reference numeral 26.

TABLE 1

| Pair Bet Bonus | |
|---|---|
| Partial Hand Rank | Award |
| Pair of Aces | 40 to 1 |
| Pair of Kings | 30 to 1 |
| Pair of Jacks or Queens | 20 to 1 |
| Pair of 8's, 9's or 10's | 11 to 1 |
| Pair of 7's or less | 9 to 1 |

As shown above, if the partial hand rank is a pair of any kind, a player placing the side wager will win an award. In this embodiment, the award is determined by multiplying the side wager according to Table 1 based on the actual pair. For example, a partial hand consisting of a pair of 8's will pay 11 times the side wager. It should be readily apparent that the preset criteria may include awards for other hands, such as a two card flush or straight. Furthermore, other award multiples may be employed depending on the desired return to the casino, among other things. In other embodiments, the preset criteria may include other possible hand ranks depending on the amount of cards dealt to each player to form their respective partial hand.

In this embodiment, one of the community cards is either dealt face up or turned over in community card area 14 while the other community cards are dealt face down in area 14 or otherwise remain unknown to the players during this first game event. Thus, a game event occurs in which the player must either place a second wager in second wager area 20 to continue or fold, that is, forfeit the game and lose the ante placed in ante wager area 18. In this embodiment, the secondary game is determined independently of the outcome of the base game. Thus, a player may win an award on the side wager but forfeit the ante wager by not placing a second wager in area 20.

If a player places the second wager in area 20, a second community card is revealed in community card area 14 and players have an opportunity to place a third or "raise" wager in wager area 22 at a second game event. After the second game event, the remaining two community cards are revealed in area 14. A final hand consisting of the four community cards and each remaining player's partial two card hand is used to determine the outcome of the game. In this embodiment, the outcome is determined by comparing the highest five card poker rank achievable from the six cards in each player's final hand with preset criteria having corresponding multiples based on the total amount wagered.

An exemplary paytable is shown below in Table 2 and illustrated in layout 10 by reference numeral 28.

TABLE 2

| Game Outcome | |
|---|---|
| Final Hand Rank | Award |
| Royal Flush | 200 to 1 |
| Straight Flush | 50 to 1 |
| Four of a kind | 15 to 1 |
| Full House | 6 to 1 |
| Flush | 5 to 1 |
| Straight | 4 to 1 |
| Three of a kind | 2 to 1 |

TABLE 2-continued

| Game Outcome | |
|---|---|
| Final Hand Rank | Award |
| Two Pair | 1 to 1 |
| Pair of Jacks or Better | 1 to 1 |

As shown above, if the final hand rank is of a value less than a pair of Jacks, then the player does not win an award. If the final hand rank is of a value greater than a pair of Jacks according to standard poker rules, then the player will win an award. In this embodiment, the award is determined by multiplying the side wager according to Table 2 based on the actual final hand rank achieved. For example, a final hand consisting of a straight will entitle the player to be paid four times the amount of their cumulative wagers, that is, four times the sum of the ante and the second wager plus the third wager, if any. It should be readily apparent that the preset criteria may include awards for other hands and other award multiples may be employed depending on the desired return to the casino, among other things.

It should be understood that a game according to the present invention may be incorporated in a fully or partially automated or interactive, computerized platform supporting multiple player positions. It should be readily apparent that additional computerized or manual systems may be employed in accordance with the present invention in order to achieve its full implementation.

Those skilled in the art will readily appreciate that the method described above may be incorporated in an electronic gaming machine or system in accordance with the invention. Such system or machine may include various computer and network related software and hardware, such as programs, operating systems, memory storage devices, input/output devices for data or monetary transfers, display devices, processors, servers with links to data communication systems, wireless or otherwise, and data transceiving terminals. Those skilled in the art will further appreciate that the precise types of software and hardware used are not vital to the full implementation of the present invention so long as players and operators of the present invention are provided with useful access thereto as described in exemplary embodiments herein.

While exemplary methods and applications of the methods of the present disclosure, have been described herein, it should also be understood that the foregoing is only illustrative of exemplary embodiments, as well as principles of the invention, and that various modifications can be made by those skilled in the art without departing from the scope and spirit of the invention. Therefore, the described embodiments should not be considered as limiting of the invention in any way. Accordingly, the invention embraces alternatives, modifications and variations which fall within the spirit and scope of the invention as described and claimed.

What is claimed is:

1. A system for providing a wagering game comprising:

a) an input device configured for receiving an ante wager from a participating player;

b) a processor configured for:

i) providing the participating player with a partial hand of playing cards;

ii) providing a community group of playing cards of unknown value;

iii) conducting one or more game events so long as there is at least one playing card of unknown value remaining in the community group of playing cards, including a first game event and a second game event, the first game event comprising revealing the value of at least one playing card in the community group to the participating player and receiving a mandatory game event wager from the participating player thereafter, wherein the ante wager is forfeited if the mandatory game event wager is not received, and the second game event comprising revealing the value of at least one other playing card in the community group to the participating player and receiving an optional game event wager, wherein the ante wager is not forfeited if the optional wager is not received;

iv) revealing the at least one remaining playing card of unknown value among the community group of playing cards;

v) determining a final hand rank for the participating player, wherein the final hand rank is based on the cards in the participating player's partial hand and the community group of playing cards; and vi) comparing the final hand rank with a preset criteria, wherein the preset criteria sets forth guidelines for award payouts based on final hand ranks;

c) a display device configured for displaying the partial hand of playing cards to the participating player and revealing the value of the community group of cards during the game; and d) an output device for paying a game award payout to the player if one of the preset criteria are satisfied, wherein the game award payout is at least partially based on the total amount wagered, and wherein the total amount wagered is the ante wager plus the sum of all the game event wagers received during the one or more game events.

2. A system according to claim 1, wherein a preset amount of game events are conducted by the processor.

3. A system according to claim 1, wherein the combined amount of cards revealed during the game events, cards in the partial hand and cards remaining unknown is at least one card greater than necessary to determine the rank of the final hand.

4. A system according to claim 1, wherein the amount of cards revealed during the game events and the amount of cards in the partial hand are at least one card less than necessary to determine the rank of the final hand.

5. A system according to claim 1, wherein the ante wager and at least one game event wager are mandatory wagers.

6. A system according to claim 1, wherein the input device is further configured for receiving a secondary game wager prior to delivering the partial game hand to the participating player, and the processor is further configured for:

i) determining a partial hand rank for the participating player, wherein the partial hand rank is based on the cards in the participating player's partial hand;

ii) comparing the partial hand rank with a secondary game preset criteria, wherein the secondary game preset criteria sets forth guidelines for award payouts based on partial hand ranks; and iii) paying a secondary game award payout to the participating player if one of the secondary game preset criteria are satisfied, wherein the secondary game award payout is at least partially based on the secondary game wager amount.

* * * * *